US007841599B2

(12) United States Patent
Todokoro

(10) Patent No.: US 7,841,599 B2
(45) Date of Patent: Nov. 30, 2010

(54) HOME-USE CRANE GAME MACHINE

(75) Inventor: Shinji Todokoro, Tokyo (JP)

(73) Assignee: Agatsuma Co., Ltd., Tokyo (JP)

( * ) Notice: Subject to any disclaimer, the term of this patent is extended or adjusted under 35 U.S.C. 154(b) by 558 days.

(21) Appl. No.: 11/613,351

(22) Filed: Dec. 20, 2006

(65) Prior Publication Data

US 2008/0088092 A1 Apr. 17, 2008

(30) Foreign Application Priority Data

Oct. 12, 2006 (JP) ..... 2006-278683

(51) Int. Cl.
*A63B 67/00* (2006.01)

(52) U.S. Cl. ..... 273/447; 273/440; 273/448

(58) Field of Classification Search ..... 273/440, 273/447, 448

See application file for complete search history.

(56) References Cited

U.S. PATENT DOCUMENTS 4,412,682 A * 11/1983 Rehkemper et al. ..... 273/447
4,778,176 A * 10/1988 Shoemaker, Jr. ..... 273/448
4,813,670 A * 3/1989 Mizunuma ..... 273/447
4,900,026 A * 2/1990 Kulesza et al. ..... 273/119 A
4,961,580 A * 10/1990 Yoe et al. ..... 273/447
4,976,440 A * 12/1990 Faith ..... 273/362
5,271,628 A * 12/1993 Okada ..... 273/448
5,358,219 A * 10/1994 Shenk et al. ..... 254/269
5,397,134 A * 3/1995 Fishman et al. ..... 463/25
5,415,417 A * 5/1995 Reis, Jr. ..... 273/447
5,513,772 A * 5/1996 Glaser ..... 221/211
5,527,044 A * 6/1996 Lee et al. ..... 273/448
5,549,372 A * 8/1996 Lewis ..... 312/114
5,653,446 A * 8/1997 Lin ..... 273/447
D389,891 S * 1/1998 Kawasaki ..... D21/811
5,711,530 A * 1/1998 Lewis ..... 273/448
5,741,013 A * 4/1998 Hamano et al. ..... 273/447
5,855,374 A * 1/1999 Shoemaker, Jr. ..... 273/447
5,967,892 A * 10/1999 Shoemaker, Jr. ..... 463/7
D421,284 S * 2/2000 Huang ..... D21/811
6,139,429 A * 10/2000 Shoemaker, Jr. ..... 463/7
6,152,447 A * 11/2000 Stanley ..... 273/138.1

(Continued)

FOREIGN PATENT DOCUMENTS

JP 06-319869 11/1994

OTHER PUBLICATIONS

Toy Journal for Tokyo Toy Show 2006, Toy Catalog, Jul. 5, 2006, Tokyo Toys & Dolls Wholesaler Corporation Union.

*Primary Examiner*—Gene Kim
*Assistant Examiner*—Alexander R Niconovich
(74) *Attorney, Agent, or Firm*—The Marbury Law Group PLLC

(57) ABSTRACT

The invention provides a home-use crane game machine that gives a player a strained sensation of operation similar to playing a game apparatus disposed in the amusement arcade or the like and that young children can play easily. The home-use crane game machine comprises a base part having a first button, a second button and a main board having a control device, a housing part, a crane part having a catcher having a bottom part formed in the shape of teeth and a standing wall plate vertically protruding on the side of the bottom part and a crane main body for controlling the movement of the catcher in X axis direction, Y axis direction and Z axis direction, and a roof, wherein the control device moves the catcher in X axis direction, Y axis direction and Z axis direction.

4 Claims, 7 Drawing Sheets

U.S. PATENT DOCUMENTS 6,234,487 B1 * 5/2001 Shoemaker, Jr. ..... 273/447
6,283,475 B1 * 9/2001 Stubben ..... 273/448
6,336,636 B1 * 1/2002 Smart ..... 273/447
6,428,008 B1 * 8/2002 Singer ..... 273/447
6,454,261 B2 * 9/2002 Ohira ..... 273/140
6,550,774 B1 * 4/2003 Stroll et al. ..... 273/447
6,588,760 B2 * 7/2003 Carter et al. ..... 273/448
6,598,881 B1 * 7/2003 Shoemaker, Jr. ..... 273/447
6,634,940 B2 * 10/2003 Yoshida et al. ..... 463/7
6,695,698 B1 * 2/2004 Anghelo et al. ..... 463/25
6,770,001 B1 * 8/2004 Shoemaker, Jr. ..... 473/447
6,899,337 B2 * 5/2005 Fisher et al. ..... 273/447
6,921,076 B1 * 7/2005 Norton ..... 273/447
6,957,813 B2 * 10/2005 Verstraeten ..... 273/448
7,080,840 B1 * 7/2006 Chen ..... 273/447
7,168,706 B2 * 1/2007 Pierce et al. ..... 273/448
7,264,247 B2 * 9/2007 Singer ..... 273/447
7,334,798 B2 * 2/2008 Halliburton ..... 273/447
7,549,646 B2 * 6/2009 Yumiya ..... 273/448
7,594,662 B2 * 9/2009 Fukazawa et al. ..... 273/447
7,604,238 B2 * 10/2009 Verstraeten ..... 273/448
7,635,131 B2 * 12/2009 Fukazawa et al. ..... 273/447
7,637,507 B2 * 12/2009 Peck et al. ..... 273/448
7,648,142 B2 * 1/2010 Watanabe et al. ..... 273/448
2002/0067002 A1 * 6/2002 Yoshida et al. ..... 273/447
2002/0140171 A1 * 10/2002 Ochi ..... 273/448
2003/0090065 A1 * 5/2003 Carter et al. ..... 273/447
2003/0151202 A1 * 8/2003 Fisher et al. ..... 273/447
2003/0181230 A1 * 9/2003 Shimoda ..... 463/7
2004/0026865 A1 * 2/2004 Verstraeten ..... 273/448
2005/0218602 A1 * 10/2005 Watanabe et al. ..... 273/447
2006/0170164 A1 * 8/2006 Watanabe ..... 273/447
2006/0249909 A1 * 11/2006 Yumiya ..... 273/447
2006/0255544 A1 * 11/2006 Halliburton ..... 273/447
2007/0013139 A1 * 1/2007 Kumagai ..... 273/448
2007/0029734 A1 * 2/2007 Fukazawa et al. ..... 273/447
2007/0114725 A1 * 5/2007 Peck et al. ..... 273/447
2007/0210523 A1 * 9/2007 Verstraeten ..... 273/447
2008/0001360 A1 * 1/2008 Fukazawa ..... 273/448
2008/0242413 A1 * 10/2008 Matsuda ..... 463/38
2009/0191931 A1 * 7/2009 Peck ..... 463/7
2009/0267302 A1 * 10/2009 Fukazawa et al. ..... 273/447
2009/0278318 A1 * 11/2009 Takasugi ..... 273/448
2009/0295095 A1 * 12/2009 Watanabe et al. ..... 273/448
2010/0090408 A1 * 4/2010 Fukazawa et al. ..... 273/447

* cited by examiner

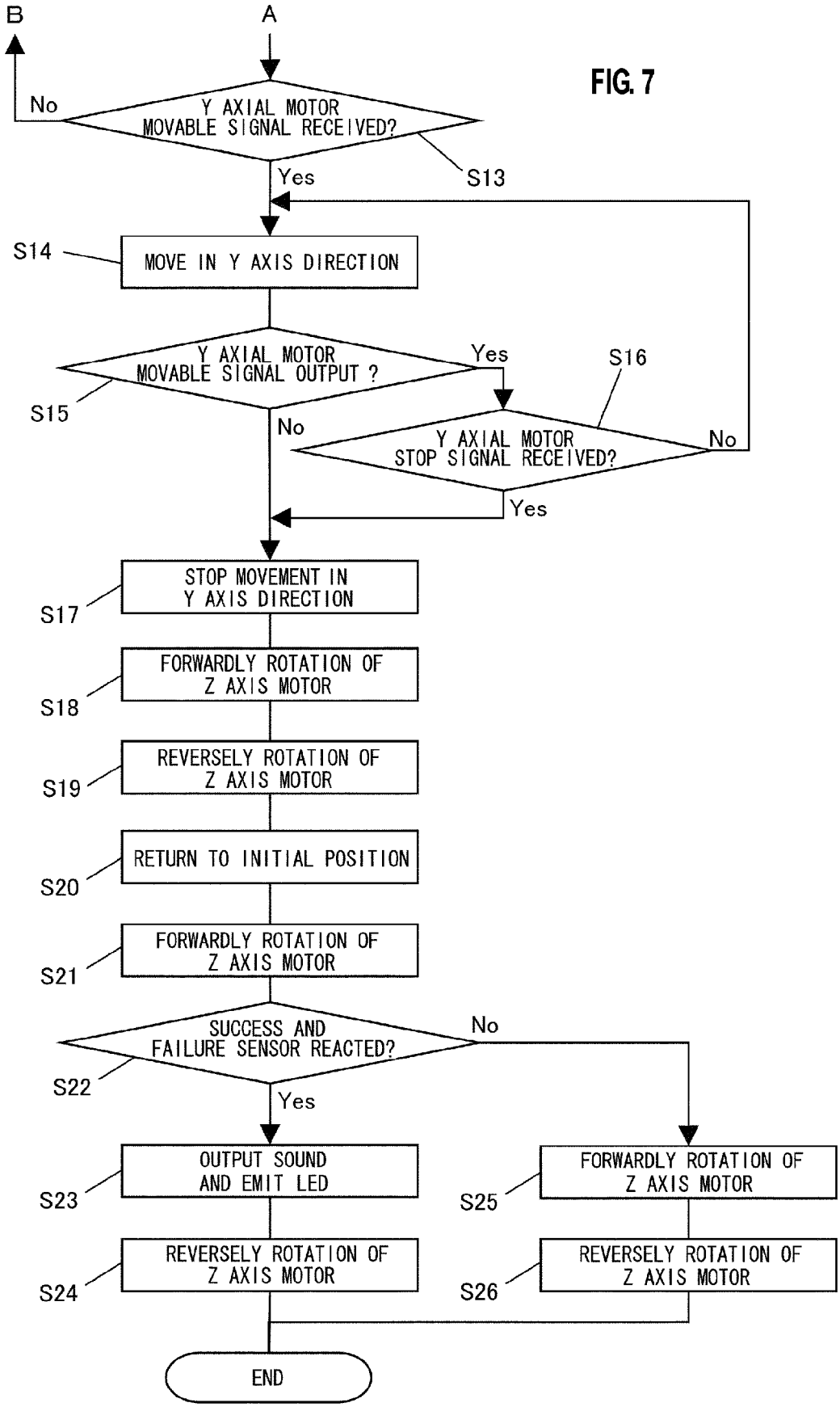
B
A
FIG. 7
No
Y AXIAL MOTOR MOVABLE SIGNAL RECEIVED?
S13
Yes
S14
MOVE IN Y AXIS DIRECTION
Y AXIAL MOTOR MOVABLE SIGNAL OUTPUT ?
Yes
S16
S15
No
Y AXIAL MOTOR STOP SIGNAL RECEIVED?
No
Yes
STOP MOVEMENT IN Y AXIS DIRECTION
S17
FORWARDLY ROTATION OF Z AXIS MOTOR
S18
REVERSELY ROTATION OF Z AXIS MOTOR
S19
RETURN TO INITIAL POSITION
S20
FORWARDLY ROTATION OF Z AXIS MOTOR
S21
SUCCESS AND FAILURE SENSOR REACTED?
No
S22
Yes
OUTPUT SOUND AND EMIT LED
S23
FORWARDLY ROTATION OF Z AXIS MOTOR
S25
REVERSELY ROTATION OF Z AXIS MOTOR
S24
REVERSELY ROTATION OF Z AXIS MOTOR
S26
END

HOME-USE CRANE GAME MACHINE

BACKGROUND OF THE INVENTION

1. Field of the Invention

The present invention relates to a home-use crane game machine.

2. Description of Prior Art

Recently, as one of game machines which is often found in the entrance of an amusement arcade, a bookstore, a CD shop or the like, there is a crane game apparatus which a prize on the inside is caught by controlling a crane. Many prizes are housed inside of the crane game apparatus, when a player stops the crane at the arbitrary position by controlling the movement in the lateral and longitudinal direction thereof with buttons after inserting a coin, the crane moves down to the bottom at this position with a catcher being opened and then moves up with the catcher being closed, then, the player can get a prize if the catcher catches it successfully.

However, this crane game apparatus could not be played in the home because it is generally very large in size. So, downsized home-use crane game machines to play in the home are provided. For example, a game machine, of which a crane moves in lateral direction after inserting a coin, and where a player stops the lateral movement of the crane and controls the vertical movement of a catcher by operating a lever for getting a prize, is provided in Japanese Patent Application Publication H06-319869.

In a conventional home-use crane game machine described above, the crane keeps moving for a fixed time after inserting a coin, thus, the player can catch prizes many times with one coin. And, the crane only moves in a lateral direction, thus, the player only controls the vertical movement of the catcher by operating the lever. Although the appearance and game structure of the conventional home-use crane game machine are similar to the crane game apparatus disposed in the amusement arcade or the like, they are two completely different game machine, the player does not have a sensation of strain that the game can not be started over because multiple challenges can be done with one coin.

Additionally, a prize drops on moving the crane or can not be caught often because the catcher is small and for that reason the prize can not be easily caught, thus, young children can not play easily.

SUMMARY OF THE INVENTION

The present invention was made in view of above problems, an object of this is to provide a home-use crane game machine which is similar to a real machine, which the player has a sensation of strain during the play and which young children can play easily.

A home-use crane game machine 1 of the present invention comprises a base part 2 having a first button 24 for outputting a X axial motor movable signal, a second button 25 for outputting a Y axial motor movable signal and a main board having a control device 101, a housing part 3 having a housing space for housing prizes in the inside, which is internally visible and is disposed on the base part, a crane part 4 having a catcher 65 having a bottom part formed in the shape of teeth and a standing wall plate 76 vertically protruding on the side of the bottom part and forming a prize-holding space over the bottom part and a crane main body 54 for controlling the movement of the catcher 65 in X axis direction, Y axis direction and Z axis direction, and a roof 5 for covering the upper part of the housing part 3, wherein the control device 101 moves the crane main body 54 with the catcher 65 in X axis direction while the X axial motor movable signal is output by operating the first button 24, makes the first button 24 unoperatable with stopping the movement in X axis direction when the X axial motor movable signal is stopped, moves the crane main body 54 with the catcher 65 in Y axis direction when the second button 25 can be operated after being the first button 24 unoperatable and a Y axial motor movable signal is output, returns the crane main body 54 with the catcher 65 to an initial position after only the catcher 65 is moved in Z axis direction when the Y axial motor movable signal is stopped, and then opens and closes the catcher after moving only the catcher 65 in Z axis direction.

In addition, the housing part 3 is a cylinder having a square section which four transparent plates 42 are disposed between four support columns 41, and light emitting diodes (LEDs) are internally fitted in the support columns 41 and one of the four transparent plates 42 is openably and closably fixed.

Moreover, the base part 2 has an infrared sensor 106 which detects falling of a prize, and the control device 101 reversely rotates the Z axis motor that serves as the power of the catcher 65, operates a sound output device 107, and turns on the light emitting diodes internally fitted in the support columns 41 of the housing part 3 when the infrared sensor 106 reacts.

Also, the base part 2 has a prize receiving tray 35, and the prize receiving tray 35 is protruded from the base part 2 to the front side, and the upper surface of the base part 2 is a prize placement board 22 of which the center inclines so as to be lower than a periphery thereof.

The catcher 65 comprises a catcher main body part 71 and upper supporting part 72 mutually interlocked with each other, wherein a first chain 66 is connected to the catcher main body part 71 and a second chain 67 is connected to the upper supporting part 72, the catcher main body part 71 is opened when the catcher 65 is hung by the second chain 67 and the catcher main body part 71 is closed when the catcher 65 is hung by the first chain 66.

Additionally, the prize-holding space in closed condition of the catcher 65 is approximately equal to the size of prizes.

According to the present invention described above, since the first button becomes unoperatable after the crane main body was moved in X axis direction with the catcher by pressing the first button, the catcher can be moved only once in X axis direction and Y axis direction with one coin, thus, the home-use crane game machine which is similar to real machine and is played with a sensation of strain can be provided.

Also, since the standing wall plates are formed to the catcher, the prize does not drop when the crane main body and catcher move, thus, young children can play easily. And, since the prize receiving tray is protruded to the base part, young children can easily take the prize.

And, since one of the transparent plates of the housing part is fitted being opened and closed, prizes may be easily housed in the housing part. And, since LEDs are output with linking sounds, young children's interest can be aroused.

Additionally, since the prize placement board 22, of which the center is lower than its periphery, is provided on the base part, the small number of residual prizes can be gathered in the center thereof, thus young children can easily move the catcher to the position of prizes. And, since the prize-holding space of the catcher and the size of prize are approximately equal, the prize can be easily held with the catcher.

BRIEF DESCRIPTION OF THE DRAWINGS

FIG. 7 is also a flowchart showing the operation of the crane game of the embodiment of the present invention.

BEST MODE FOR CARRYING OUT THE INVENTION

Figure 1:
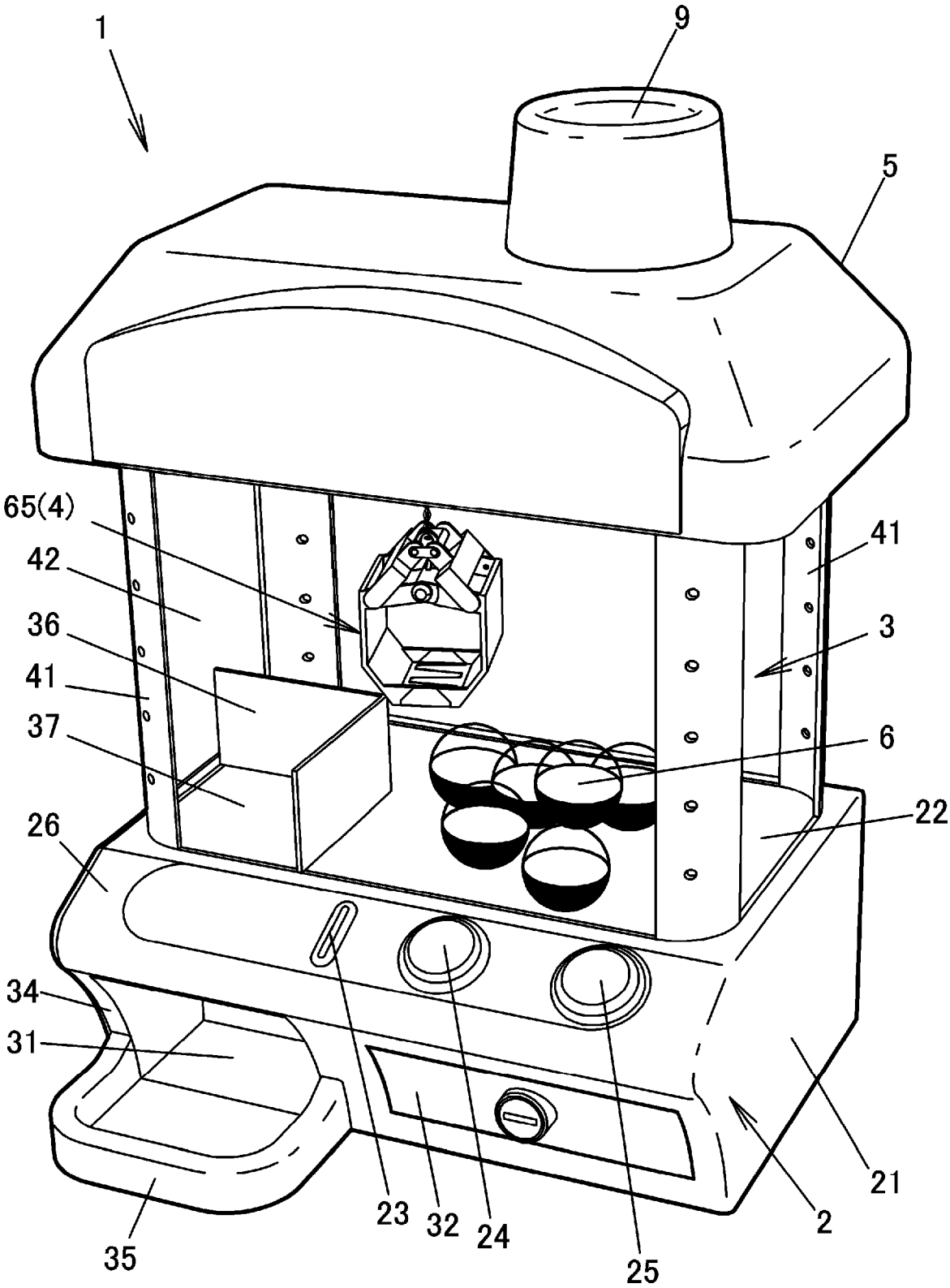
FIG. 1 is a perspective view of a home-use crane game machine of the present invention.

A home-use crane game machine 1 of the best mode for carrying out the present invention comprises a base part 2 having a first button 24 for outputting a X axial motor movable signal, a second button 25 for outputting a Y axial motor movable signal and a main board having a control device 101, a housing part 3 having a housing space for housing prizes in the inside, which is internally visible and is disposed on the base part, a crane part 4 having a catcher 65 having a bottom part formed in the shape of teeth and a standing wall plate 76 vertically protruding on the side of the bottom part and forming a prize-holding space over the bottom part and a crane main body 54 for controlling the movement of the catcher 65 in X axis direction, Y axis direction and Z axis direction, and a roof 5 for covering the upper parts of the housing part 3.

And, the control device 101 moves the crane main body 54 with the catcher 65 in X axis direction while the X axial motor movable signal is output by operating the first button 24, makes the first button 24 unoperatable with stopping the movement in X axis direction when the X axial motor movable signal is stopped, moves the crane main body 54 with the catcher 65 in Y axis direction when the second button 25 can be operated after being the first button 24 unoperatable and a Y axial motor movable signal is output, returns the crane main body 54 with the catcher 65 to an initial position after only the catcher 65 is moved in Z axis direction when the Y axial motor movable signal is stopped, and then opens and closes the catcher after moving only the catcher 65 in Z axis direction.

In addition, the housing part 3 is a cylinder having a square section which four transparent plates 42 are disposed between four support columns 41, and light emitting diodes (LEDs) are internally fitted in the support columns 41 and one of the four transparent plates 42 is openably and closably fixed.

Moreover, the base part 2 has an infrared sensor 106 which detects falling of a prize, and the control device 101 reversely rotates the Z axis motor that serves as the power of the catcher 65, operates a sound output device 107, and turns on the light emitting diodes internally fitted in the support columns 41 of the housing part 3 when the infrared sensor 106 reacts.

Also, the base part 2 has a prize receiving tray 35, and the prize receiving tray 35 is protruded from the base part 2 to the front side, and the upper surface of the base part 2 is a prize placement board 22 of which the center inclines so as to be lower than the periphery thereof.

And, the catcher 65 comprises a catcher main body part 71 and upper supporting part 72 mutually interlocked with each other, wherein a first chain 66 is connected to the catcher main body part 71 and a second chain 67 is connected to the upper supporting part 72, the catcher main body part 71 is opened when the catcher 65 is hung by the second chain 67 and the catcher main body part 71 is closed when the catcher 65 is hung by the first chain 66.

Additionally, the prize-holding space in closed condition of the catcher 65 is approximately equal to the size of prize.

An embodiment of the present invention will be described below by reference to the drawings. As shown in FIG. 1, a crane game machine 1 of the embodiment is for playing in the home, it comprises a base part 2 which is a base of the crane game machine 1 and has a space in the inside, a housing part 3 in which prizes 6 are housed, a crane part 4 positioned over the housing part 3, and a roof 5 for covering the upper parts of the housing part 3 and crane part 4. Note that a lateral direction of the crane game machine 1 is X axis, a longitudinal direction from front to back is Y axis, and height direction from top to bottom is Z axis in the description below.

The base part 2 comprises a base main body 21 being an approximately rectangular parallelepiped shape whose top and bottom are open, a prize placement board 22 covering a part of the top opening of the base main body 21, a control part arranging plate 26 having a coin slot 23, first button 24 and second button 25 and to be arranged on a front side of the base main body 21, and a bottom plate arranged on a bottom of the base main body 21.

A prize discharge port 31 being a rectangular shape is provided in near the left end of the front of the base main body 21 and a storage box opening for taking in and out a coin storage box 32 is formed from the center to near the right end of the front thereof. A peripheral edge of the prize discharge port 31 is covered with a peripheral edge cover 34, and a prize receiving tray 35 is protruded from the lower end of the prize discharge port 31.

The prize receiving tray 35 comprises a flat plate being a rectangular shape with round corners and a thick peripheral wall protruding upward vertically from the peripheral edge of the flat plate except for the edge fitted to the prize discharge port 31, young children can easily take the prize 6 since the prize receiving tray 35 is formed so as to be flat and protrude from the base main body 21, and the peripheral wall prevents the prize 6 from popping out from the prize discharge port 31.

The coin storage box 32 is an approximately rectangular parallelepiped shape whose top is open, and has a keyhole in front thereof. Coins are taken out from the coin storage box 32 by sliding it from the storage box opening of the base main body 21. And, pictures such as characters or the like are provided on the front surface of the coin storage box 32 and a key inserted in the keyhole. Therefore, the coin storage box 32 can be used as a saving box.

Moreover, a main switch (not shown) of the crane game machine 1 is provided in the back side of the base main body 21. And, a battery storage box for storing batteries being main electric power and a sound output device 107 for outputting various sounds are provided on the bottom surface of the base main body 21.

The prize placement board 22 is a L-shaped plate forming a square-shaped notch part at a prescribed corner of a square plate, and the center thereof is inclined so as to be slightly lower than the periphery thereof.

The notch part of the prize placement board 22 is, as shown in FIG. 1, a prize drop port 37 which connects to the prize discharge port 31 formed near the front end of the base main body 21, a transparent prize guide wall 36 is vertically protruded to the peripheral edge of the prize drop port 37. The prize guide wall 36 guides the prize 6 to the prize drop port 37 when the prize 6 held by the catcher 65 of the crane part 4 is fallen to the prize drop port 37.

The control part arranging plate 26 of the base part 2 is an approximately rectangular plate and is arranged so as to be slightly oblique towards the forward. And, lamps which shine by responding an infrared sensor 106 described below are built into near the left side of the control part arranging plate 26, a figure body such as characters can be provided over the lamps.

And, the coin slot 23 is formed near the center of the control part arranging plate 26, a coin feed sensor 105 for detecting the insertion of the coins is arranged directly below the coin slot 23. The first button 24 for controlling the movement of a crane main body 54 described below in a X axis direction (lateral direction) and the second button 25 for controlling the movement of the crane main body 54 in a Y axis direction (longitudinal direction) are arranged in parallel between the coin slot 23 and the end of the control part arranging plate 26, and a main board is placed on the back side of the first button 24 and second button 25.

A switch inside the coin feed sensor 105 is pushed by a coin to operate when the coin is inserted. And, the sound is generated and the first button 24 can be operateble when the coin is inserted in the state of a main switch ON, and then the inserted coin falls to a coin storage box 32.

In addition, a path for going through the prize 6 is formed between the prize drop port 37 and the prize discharge port 31, and the infrared sensor 106 is disposed on the side surface of the path. The infrared sensor 106 reacts when the prize 6 passed through the path of between the prize drop port 37 and the prize discharge port 31 and outputs an acquisition success signal of the prize 6 to the main board.

The housing part 3 comprises, as shown in FIG. 1, four support columns 41, four transparent plates 42 and prizes 6 housing inside, a picture printed with characters or the like is displayed on the back surface.

And, the prize 6 is a spherical container of which at least hemisphere is transparent, where an object such as a miniature figure of character is putted inside.

Support columns 41 are each vertically fixed to near four corners of the base part 2, and lamps such as LED are mounted inside thereof. And, four transparent plates 42 are each fixed between four support columns 41. Additionally, the right transparent plate 42 is provided with an opening and closing type, a holder for holding this right transparent plate 42 is provided in one of the support column 41 for fixing the right transparent plate 42.

Columnar protrusions are upwardly and downwardly protruded from the side end parts of the transparent plate 42 disposed on the right side, the lower protrusion is fitted and inserted to the base part 2 and the upper protrusion is fitted and inserted to a movable part support frame 52 described below, thus this right transparent plate 42 rotates around these protrusions as an axis. Therefore, the right transparent plate 42 can be freely rotatable when the holder provided in the support column 41 is taken off, and an internal foreign substances and the like of the housing part 3 can be removed by opening the transparent plate 42 disposed on the right side.

Figure 2:
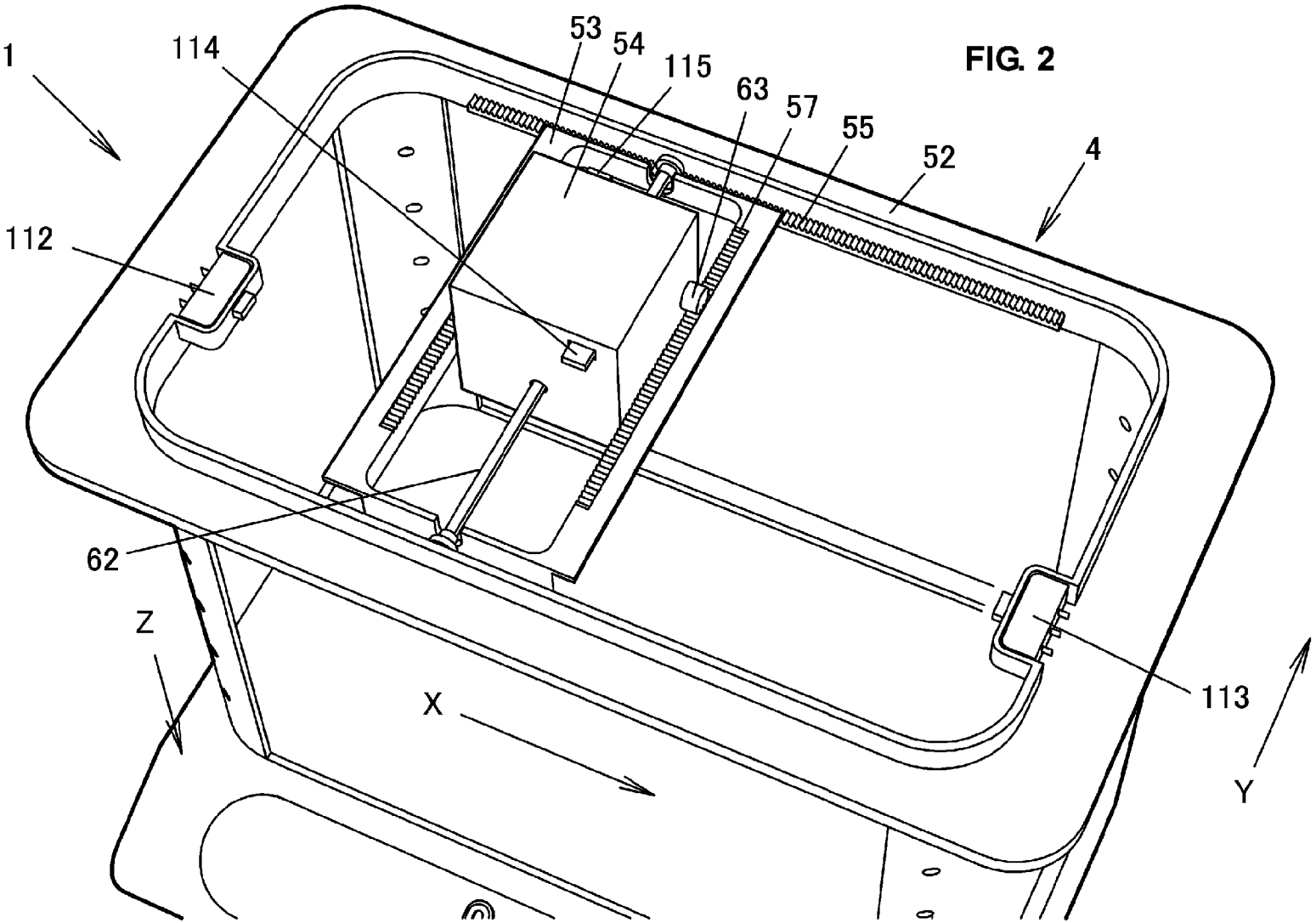
FIG. 2 is a top surface view of a housing part of which the roof is took off.

The crane part 4 comprises, as shown in FIG. 2, the movable part support frame 52 covering the above part of transparent plates 42 and support columns 41, a slide frame 53 sliding on the movable part support frame 52, the crane main body 54 attached to the slide frame 53 and a movable part cover (not shown) covering the crane main body 54.

The movable part support frame 52 is a rectangular frame covering the above part of transparent plates 42 and support column 41, X axial sliding racks 55 are each protruded on the front and back inner surfaces of the frame so as to be facing each other, and the slide frame 53 having the crane main body 54 slides to X axis direction along these X axial sliding racks 55. And, a X axis first switch 112 is disposed at a X axis original position provided in the inner side of one frame part of the movable part support frame 52 paralleled to the Y axis direction and a X axis second switch 113 is disposed at a X axis limit position provided in the inner side of another frame part of the movable part support frame 52 paralleled to the Y axis direction, where the movement in X axis direction of the slide frame 53 is stopped when the X axis first switch 112 or X axis second switch 113 is pressed down by the slide frame 53 having the crane main body 54.

The slide frame 53 is a rectangular frame wherein the Y axis direction is its longitudinal direction, the length of longitudinal direction is approximately same as the length of inner side of the Y axis direction of the movable part support frame 52. Upper frame parts are each outwardly protruded from upper parts of both sides of frame which is parallel to Y axis direction of the slide frame 53, and Y axial sliding racks 57 are each formed on the upper surface of upper frame parts. Lower frame parts are each outwardly protruded from lower parts of both sides of frame which is parallel to X axis direction of the slide frame 53 so as to protrude under the movable part support frame 52, and notches in which a X axial movable axis of the crane main body 54 (described below) is set are formed at each center of both side of frame which is parallel to axis direction of the slide frame 53 from top to near bottom.

The crane main body 54 is an approximately rectangular parallelepiped box shape of which inside is blocked out to three stages, and lower protrusions are each formed near bottom part of outer surfaces thereof which are parallel to Y axis direction of the crane main body 54. And a X axis motor and Y axis motor being powers for movement in X axis and Y axis direction are each disposed inside of the lower stage of the crane main body 54. Additionally, end parts of the X axial movable axis 62 having gears for meshing to X axial sliding racks 55 of the movable part support frame 52 at end parts thereof and end parts of a Y axial movable axis 63 having gears for meshing to Y axial sliding racks 57 of the slide frame 53 at end parts thereof are protruded from the side surface of the crane main body 54 and various gears are internally provided to it.

Figure 3:
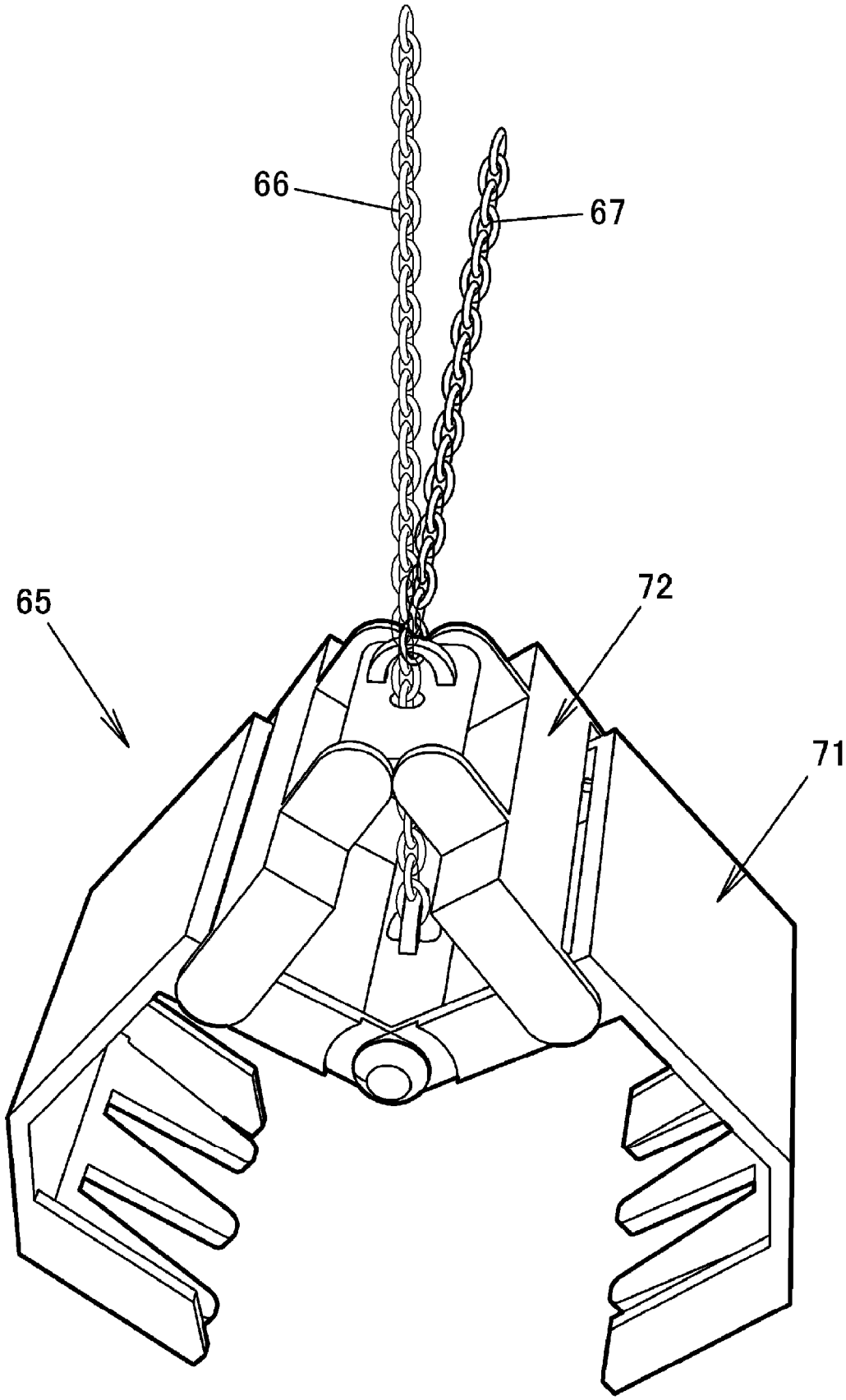
FIG. 3 is a perspective view of a catcher of an embodiment of the present invention.

A Z axis motor being a power for moving up and down a catcher 65 and various gears are disposed in the middle stage of the crane main body 54, and two chains which sling the catcher 65 are each fixed to reels, wherein these chains comprises, as shown in FIG. 3, a first chain 66 of which the end is connected to a catcher main body part 71 and a second chain 67 of which the end is connected to an upper supporting part 72. The second chain 67 slings the whole of catcher 65 when the Z axis motor rotates forwardly and the first chain 66 slings the whole of catcher 65 when the Z axis motor rotates reversely.

And, a Y axis first switch 114 is arranged in the front side of the upper stage of the crane main body 54 and a Y axis second switch 115 is arranged in the back side thereof, and a part of these switches 114, 115 are each protruded from the side face of the crane main body 54. Switches 114, 115 are pressed by touching themselves to the movable part support frame 52 when the crane main body 54 comes close the front and back frame part thereof during moving to Y axis direction and the movement of crane main body 54 in Y axis direction is stopped.

Moreover, the crane main body 54 is fitted in the slide frame 53 so as to catch the slide frame 53 from up and down with gears of the Y axial movable axis 63 and lower protrusions of the crane main body 54, where gears of the Y axial movable axis 63 meshes with Y axial sliding racks 57. And, the slide frame 53 is arranged so as to catch the movable part support frame 52 from up and down with gears of the X axial movable axis 62 and lower frames, where gears of the X axial movable axis 62 meshes with X axial sliding racks 55. Also, the slide frame 53 having the crane main body 54 is covered with the movable part cover (not shown).

Figure 4:
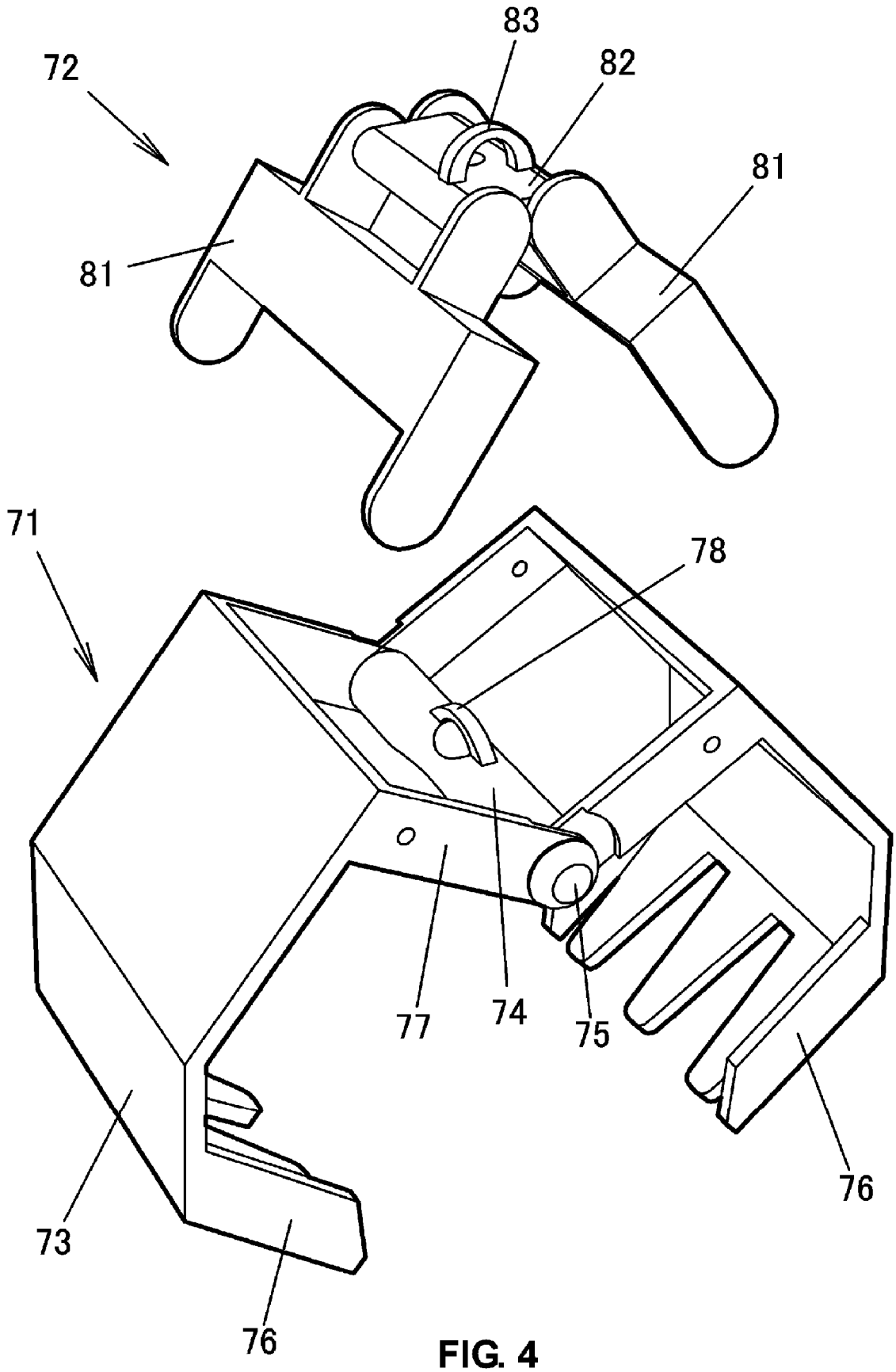
FIG. 4 is an exploded view of the catcher of the embodiment of the present invention.

The catcher 65 is for catching a prize 6, and as shown in FIG. 3, comprises the catcher main body part 71 and the upper supporting part 72. The catcher main body part 71 comprises, as shown in FIG. 4, two holding members 73 for holding the prize 6 when they are locked each other after scooping the prize 6, a holding shaft 74 being a shaft of the holding part, and pins 75 for pinning the holding members 73 to the holding shaft 74.

The bottom part of the holding member 73 is formed in tooth shape, tooth shape parts of two holding members 73 are meshed each other when they are locked each other, and as shown in FIG. 1, a bottom part being a flat surface is formed. The prize 6 can be easily scooped with the tooth shape parts when being held. And, since the bottom part of the catcher 65 is being flat surface, the catcher 65 is not opened beneath the weight of the prize 6 when the catcher 65 moves with holding the prize 6. Moreover, standing wall plates 76 are vertically formed at the both sides of the bottom part, thus, the prize 6 held in the prize-holding space above the bottom part is prevented from dropping out when the catcher 65 moves with holding the prize 6.

An oblique plate is formed near the root of the tooth shape of the bottom part, and a side plate is vertically formed at another end of the oblique plate. Flat arm parts 77 are each protruded at upper end parts of the side plate so as to be facing each other, where a rotation hole for inserting a rotational protrusion of the upper supporting part 72 described below in is formed near the base end of the arm part 77. The top end part of the arm parts 77 slightly inclines upwardly when the holding members 73 are locked each other.

A pin insertion attaching hole to which the pun 75 inserts is formed at the top end part of the arm part 77, where the top end part of arm parts 77 of one holding member 73 are each formed to be thin the inside and the top end part of arm parts 77 of another holding member 73 are each formed to be thin the outside because the two holding members 73 are locked facing each other. The pin insertion attaching hole is formed to be larger than the external shape of pin 75, the pin insertion attaching hole rotates freely at the external edge of pin 75 when the metal pin 75 penetrates.

The holding shaft 74 is a cylindrical shape having a curved part at the center thereof, where a first chain connection part 78 for connecting the first chain 66 is formed at the position facing the curved part and pin receiving parts for receiving the pin 75 are formed at the center of both end surfaces of the cylinder.

The catcher main body part 71 is formed by locking two holding members 73 being in opposition to each other with being pin insertion attaching holes of each arm part 77 thereof on the same axis, where the central axis of the holding shaft 74 is positioned on the axis of the pin insertion attaching hole and pins 75 are each engaged with pin receiving parts of the holding shaft 74 with going through the pin insertion attaching hole. When the first chain connection part 78 is pulled up in the state of opening, the catcher main body part 71 is being close by locking two holding members 73 in opposition to each other after the holding member 73 rotating around the pin 75 by the weight of the holding member 73.

Openings which are formed at both sides of the prize-holding space when holding members 73 are closed are formed so as to be smaller than the size of prize 6 by the standing wall plates 76 so that the prize 6 does not drop out from these openings when the catcher 65 moves, and the prize-holding space formed in above the closed bottom part is formed in an approximately same size as the prize 6 for easy holding the prize 6.

The upper supporting part 72 comprises, as shown in FIG. 4, two supporting members 81 connected to arm parts 77 of holding members 73 and a connecting member 82 for connecting these two supporting members 81 each. The supporting member 81 is formed by connecting two band shaped plates formed in hooked with a connecting plate so that protrusions of the plates are in opposition to each other, where the upper and lower ends of the band shaped plate are formed to round, protrusions are formed on the same surface of near the upper and lower ends, and the plates are clinched into a hook at a prescribed position of surface having protrusions. The protrusions formed on upper ends of the supporting member 81 are connecting protrusions for connecting so as to freely rotate to the connecting member 82 described below, and the protrusions formed on lower ends thereof are rotating protrusions for inserting so as to freely rotate to a rotation hole of the arm part 77.

The connecting member 82 is an approximately rectangular parallelepiped plate, where longitudinal sidewalls are formed to round. And, connecting holes for connecting to the connecting protrusions of supporting members 81 are formed in near both end sides of the sidewalls in a lateral direction, and a penetration hole for penetrating the first chain 66 is formed in the center with penetrating from the upper surface to bottom surface. Additionally, a second chain connection part 83 for connecting the second chain 67 is formed near the penetration hole.

The upper supporting part 72 is put together by connecting the connecting protrusions of the supporting member 81 to the connecting holes of the connecting member 82, and the upper supporting part 72 is connected to the catcher main body part 71 with connecting the rotating protrusions thereof to rotation holes of the arm part 77. Moreover, the first chain 66 is connected to the first chain connection part 78 of the catcher main body part 71 after penetrating to the penetrating hole of the connecting member 82 and the second chain 67 is connected to the second chain connection part 83 of the upper supporting part 72.

In moving the catcher 65 down, by loosing the first chain 66 in first by forwardly rotating the Z axis motor until slinging the catcher 65 with only the second chain 67, the holding shaft 74 of the catcher main body part 71 connected to the first chain 66 falls down by the weight of the pin 75, the holding members 73 are opened outwardly in accordance with the movement that the top parts of two supporting members 81 closes each other by pulling with the connecting member 82 of the upper supporting part 72, and the holding members 73 connected to the supporting members 81 are pulled at the point of the rotating holes of the arm part 77, and then the holding members 73 are opened outwardly around the holding shaft 74. And, the catcher 65 is moved down by reeling the second chain 67 so as to follow the first chain 66 after the holding members 73 are completely opened.

In moving the catcher 65 up, when only the first chain 66 is rolled up by reversely rotating the Z axis motor until the whole catcher 65 is slug by only the first chain 66 connected to the catcher main body part 71, the holding members 73 are closed around the holding shaft 74 because the holding shaft 74 is pulled up. And, the catcher 65 moves up by rolling the second chain 67 up so as to follow the rolling of the first chain 66 after the holding members 73 are completely closed.

Moreover, since the chain main body 54 rolls the first chain 66 up first and then rolls the second chain 67 up when the catcher 65 is moved up, the first chain 66 is pulled up with strained state being the catcher 65 closed. And, when the catcher 65 is moved down, since the first chain 66 is loosen first, the second chain 67 is moved down with strained state being the catcher 65 opened.

The roof 5 on which the pictures such as character are drawn is arranged over the above of the housing part 3, and a chimney 9 which is a prize slot is formed on the roof 5. And, a crane game machine which is popular to young children is provided by decorating or painting the machine with characters popular to young children and using sounds of the voice and music of the character's.

Figure 5:
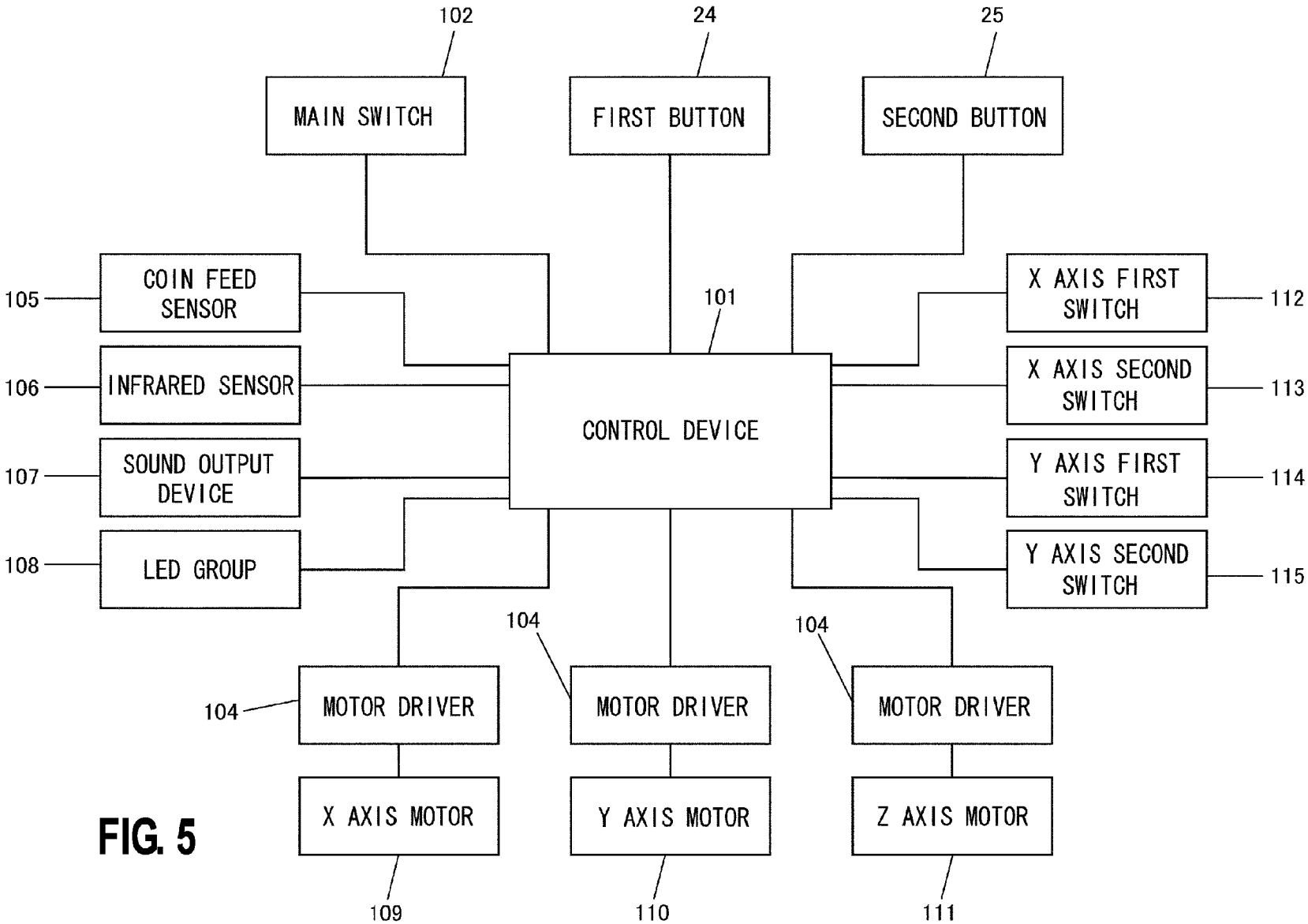
FIG. 5 is a control block diagram of a main board of the present invention.

As shown in FIG. 5, the main board has a control device 101, and a main switch 102, the first button 24, the second button 25, a motor driver 104, a coin feed sensor 105, an infrared sensor 106, a sound output device 107, a LED group 108, a X axis motor 109, a Y axis motor 110, a Z axis motor 111, a X axis first switch 112, a X axis second switch 113, a Y axis first switch 114 and a Y axis second switch 115 are connected to the control device 101.

The main switch 102 controls that the power from the battery is not supplied flow to the main board in the power OFF state and the power is supplied to the main board so as to make the coin feed sensor 105 standby in the power ON state.

And, a X axial motor movable signal is output to the control device 101 during the first button 24 is pressed, and the first button 24 can not be operated and then the second button 25 is in a standby state by the control device 101 when the first button 24 is released. And, a Y axial motor movable signal is output to the control device 101 during the second button 25 is pressed, and the driving of the Y axis motor 110 is stopped and then a Z axial motor movable signal is output to the Z axis motor 111 by the control device 101 when the second button 25 is released.

The coin feed sensor 105 outputs a game start signal to the control device 101 when it detects that the coin is inserted in the coin slot 23, and then the control device 101 outputs a prescribed sound output signal to a sound output device 107 and outputs a prescribed emission signal to the LED group 108 when it receives the game start signal.

The infrared sensor 106 detects that the prize 6 passes through the prize drop port 37, where it outputs an acquisition success signal to the control device 101 when it detects the prize 6. And then the control device 101 outputs a prescribed sound output signal for supplying to the sound output device 107 at the time of acquire success and outputs a prescribed emission signal to the LED group 108 when it receives the acquisition success signal.

The sound output device 107 outputs a sound meeting the prescribed sound output signal when it receives the prescribed sound signal from the control device 101, and the LED group 108 also emits light with a emission pattern meeting the prescribed sound output signal when it receives the prescribed emission signal from the control device 101.

And, when the motor driver 104 receives a drive control signal from the control device 101, it controls the driving of the motor by sending the power corresponding to the signal to the X axis motor 109, Y axis motor 110 and Z axis motor 111. The X axis motor 109 moves the crane main body 54 in X axis direction corresponding to the control of the motor driver 104, the Y axis motor 110 moves the crane main body 54 in Y axis direction corresponding to the control of the motor driver 104 and the Z axis motor 111 also moves the crane main body 54 in Z axis direction corresponding to the control of the motor driver 104.

The X axis first switch 112 outputs a X axial motor stop signal to the control device 101 when it is pushed by the crane main body 54 in case that the crane main body 54 returns to the original position, the X axis second switch 113 outputs the X axial motor stop signal to the control device 101 by being pushed by the crane main body 54 in case that the crane main body 54 is moving to the X axis direction by the X axis motor movable signal output from the first button 24, and the control device 101 cuts off the X axis motor movable signal from the first button 24 and turns the second button 25 to a standby state.

Also, the Y axis first switch 114 outputs a Y axial motor stop signal to the control device 101 when it is pushed by the crane main body 54 in case that the crane main body 54 returns to the original position, and the Y axis second switch 115 outputs the Y axial motor stop signal to the control device 101 by being pushed by the crane main body 54 in case that the crane main body 54 is moving to the Y axis direction by the Y axis motor movable signal output from the second button 25.

Figure 6:
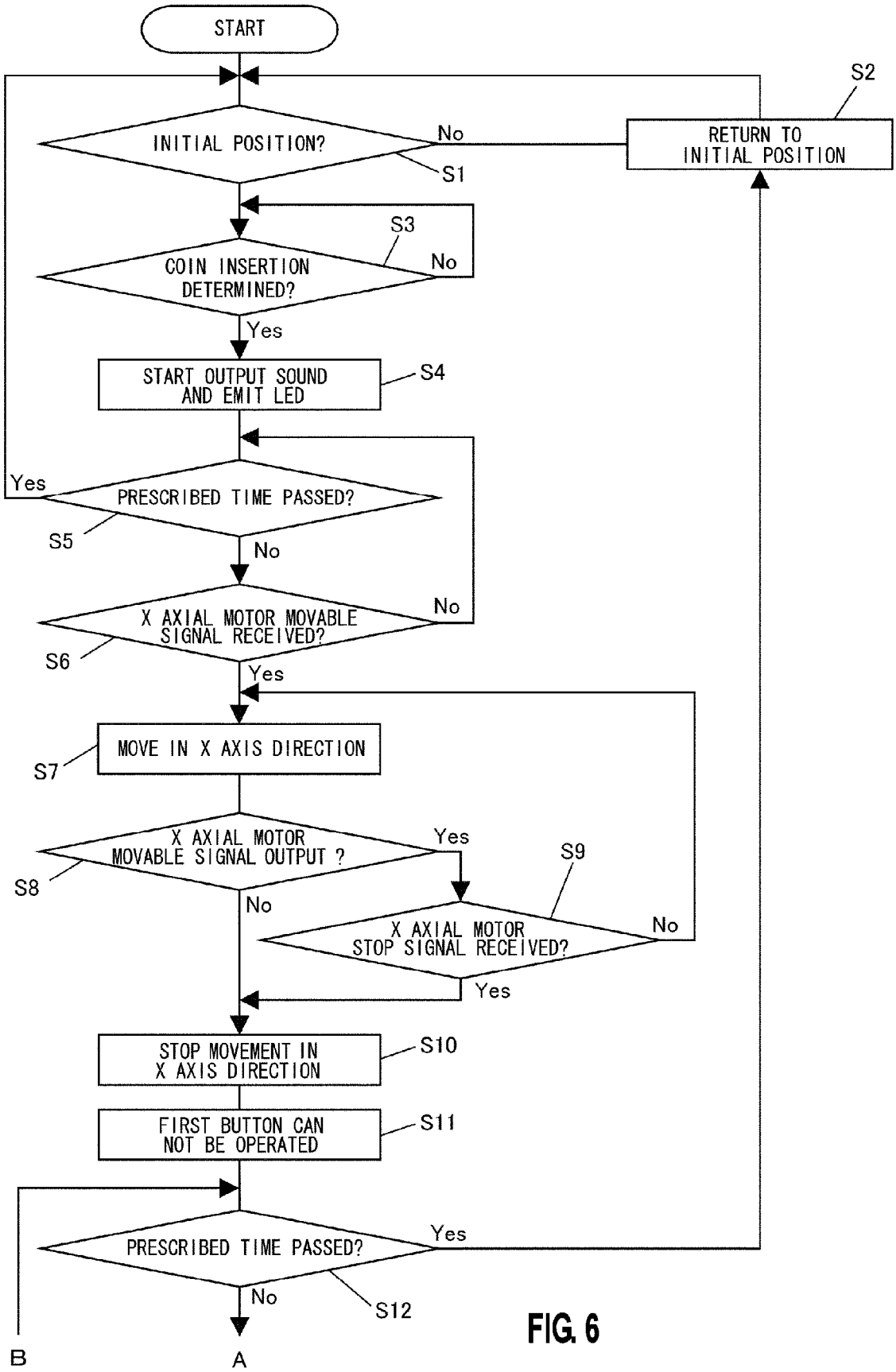
FIG. 6 is a flowchart showing the operation of the crane game machine of the embodiment of the present invention.

Then, the action of the crane game machine 1 of the embodiment is described below. When batteries are housed and the main switch 102 is turned ON, as shown in FIG. 6, the control device 101 determines whether the crane main body 54 is in an initial position by using signals from the X axis first switch 112 or Y axis first switch 114 (STEP S1), and moves the crane main body 54 to the initial position if it is not in the initial position (STEP S2). If it is confirmed that the crane main body 54 is in the initial position in the STEP S1, the insertion charging of a coin is operated (STEP S3), and the sound begins to be output and the LED group 108 begins to be emitted if the coin is inserted (STEP S4). In this time, the voice of characters and the like is supplied firstly and then the BGM (Back Ground Music) and the like are supplied. When the output of the voice of characters is completed in this sound output step, the first button 24 can be operatable.

And then, the control device 101 determines whether a button operatable prescribed time passes after inserting the coin (STEP S5), the control device 101 returns to the standby state of before inserting the coin if the prescribed time has passed. If the prescribed time has not passed, the control device 101 determines the X axial motor movable signal generated by pressing the first button 24 (STEP S6), and the crane main body 54 starts to move in the X axis direction if the X axial motor movable signal is output (STEP S7).

Continuously, the control device 101 determines whether the X axial motor movable signal is continuously output (STEP S8), the movement of the crane main body 54 in X axis direction is stopped if the X axial motor movable signal is not output (STEP S10). If the X axial motor movable signal is continued, the control device 101 determines the X axial motor stop signal which is output in case that the crane main body 54 moves to the limit position so as to press the X axis second switch 113 (STEP S9), the movement in X axis direction is stopped if the X axial motor stop signal is output (STEP S10). The control device 101 continues to move the crane main body 54 in X axis direction if the X axial motor stop signal does not output in the STEP S9 detecting the X axial motor stop signal. And, when the axial motor movable signal does not continue or the movement in X axis direction is stopped by inputting the X axial motor stop signal, the first button 24 can not be operated (STEP S11).

The control device 101 confirms again whether the prescribed time has passed after inserting the coin after the first button 24 was operated (STEP S12), the crane main body 54 is returned to the initial position so as to be finished if the prescribed time has passed (STEP S2). And, when the prescribed time has not passed, as shown in FIG. 7, the control device 101 determines the Y axial motor movable signal generated by pressing the second button 25 within a prescribed time frame (STEP S13). And then, the crane main body 54 starts to move in Y axis direction if the Y axial motor movable signal is output (STEP S14).

And, the control device 101 determines whether Y axial motor movable signal is continuously output (STEP S15), the movement of the crane main body 54 in Y axis direction is stopped if the Y axial motor movable signal is not output (STEP S17). If the Y axial motor movable signal is output, the control device 101 determines the Y axial motor stop signal which is output in case that the crane main body 54 moves to the limit position so as to press the Y axis second switch 115 (STEP S16), the movement in Y axis direction is stopped if the Y axial motor stop signal is output (STEP S17). Where, the crane main body 54 continues to move in Y axis direction if the Y axial motor stop signal is not output in STEP S16.

When the movement of the crane main body 54 in Y axis direction is stopped, the Z axis motor 111 for moving the catcher 65 starts to rotate forwardly and the catcher 65 is moved down with opening (STEP S18). And, after the catcher 65 is moved down to the bottom end with the passage of prescribed time, the Z axis motor 111 starts to rotate reversely and the catcher 65 is moved up with closing (STEP S19). And, when the catcher 65 is moved up to the upper end by the time same as falling time, the crane main body 54 is returned to the initial position (STEP S20).

The catcher 65 starts to move downwardly by forwardly rotating the Z axis motor 111 of the crane main body 54 returned to the initial position by the control device 101 (STEP S21), and the success and failure of the acquisition of prize 6 is detected by the infrared sensor 106 (STEP S22). At this point, when the control device 101 receives the acquisition success signal from the infrared sensor 106 in case that the prize 6 was successfully caught, the sound which praise the success of acquisition is output and the LED group 108 are emitted (STEP S23), and then the catcher 65 is returned to the initial position with reversely rotating the Z axis motor 111 (STEP S24) and all operations are finished. On the other, since the infrared sensor 106 does not react if the prize 6 was not caught, the control device 101 moves the catcher 65 downwardly with continuing the forwardly rotating of the Z axis motor 111 (STEP S25), and then it moves the catcher 65 upwardly with reversely rotating the Z axis motor 111 (STEP S26) and all operations are finished.

In accordance with the crane game machine 1 of the present embodiment, the crane main body 54 is controlled by the first button 24 for controlling the movement in X axis direction and the second button 25 for controlling the movement in Y axis direction, and the first button 24 does not react even it is pressed again after releasing, thus, one play can be by one coin. Therefore, the crane game machine 1 close to a real machine can be provided, and a player can be enjoyed with a sensation of strain during the play by paying attention the timing of releasing the first button 24 or second button 25.

Also, the front edge of the catcher 65 is formed like a hook so as to be horizontal state in case of closing, and wall surfaces are formed using the part of the holding member 73 in the side surfaces facing each other and standing wall plates 76 are mounted at the opening sides, thus, the crane game machine 1 which young children can catch the prize 6 with a high success rate can be provided. Moreover, the more popular crane game machine 1 among young children can be provided by adjusting the picture of characters or sounds to the machine. And, since the prize receiving tray 35 is protruded from the base part 2, young children can easily take out the prize 6 which is successfully caught.

What is claimed is:

1. A home-use crane game machine toy with a portable size and weight easily moved by a young child, comprising:

a base part having a prize placement board, a housing part disposed on the base part, a crane part provided inside the housing part and operated by a battery, and a roof for a covering the upper part of the housing part, wherein:

the base part has a first button for outputting a X axial motor movable signal, a second button for outputting a Y axial motor movable signal, an infrared sensor which detects falling of a prize and a built-in main board having a control device;

the prize placement board which forms an upper surface of the base part is configured such that a center of the prize placement board is lower than a periphery thereof, wherein the prize placement board at the near side comprises a prize receiving tray, wherein the prize receiving tray is formed so as to be flat and protrude out from the front side of the base part for ease of taking a prize out;

the housing part is internally visible and has a housing space for housing prizes in the inside, furthermore the housing part is a cylinder having a square section comprising four transparent plates disposed between four support columns, wherein light emitting diodes are internally fitted in the support columns, and one of the four transparent plates is openably and closably fixed;

the crane part comprises a catcher having a bottom part formed in the shape of teeth which forms a flat surface when the two teeth shapes are meshed; a standing wall plate vertically protruding on the side of the bottom part and forming a prize-holding space over the bottom part that is approximately equal to the size of the prize when the catcher is closed, a crane main body for controlling the movement of the catcher along a X axis direction, a Y axis direction and a Z axis direction;

the control device moves the crane main body with the catcher along the X axis direction while the X axial motor movable signal is output by operating the first button, makes the first button inoperable with stopping the movement in X axis direction when the X axial motor movable signal is stopped, moves the crane main body with the catcher in Y axis direction when the second button can be operated after being the first button inoperable and a Y axial motor movable signal is output, returns the crane main body with the catcher to an initial position after only the catcher is moved in Z axis direction when the Y axial motor movable signal is stopped, and then opens and closes the catcher after moving only the catcher in the Z axis direction, wherein the control device reversely rotates the Z axis motor that serves as the power of the catcher, operates a sound output device, and turns on the light emitting diodes internally fitted in the support columns of the housing part when the infrared sensor reacts; and the catcher comprises a catcher main body part and an upper supporting part mutually interlocked with each other, wherein a first chain is connected to the catcher main body part and a second chain is connected to the upper part, the catcher main body part is opened when the catcher is hung by the second chain and the catcher main body part is closed when the catcher is hung by the first chain.

2. The toy of claim 1, further comprising a plurality of prizes, wherein the prizes are all substantially the same size.

3. The toy of claim 2, wherein each of the prizes is spherical in shape.

4. The toy of claim 3, wherein each of the prizes comprises two hemispheres, wherein at least one hemisphere of each prize is transparent, and wherein an object is removably contained inside of each of the plurality of prizes.

* * * * *